US006726542B1

(12) United States Patent
Schoof et al.

(10) Patent No.: US 6,726,542 B1
(45) Date of Patent: Apr. 27, 2004

(54) GRINDING WHEEL, GRINDING SYSTEM AND METHOD FOR GRINDING A BLADE

(75) Inventors: Ulrich Schoof, Düsseldorf (DE); Stefan Reimann, Neuss (DE); Bernd Reh, Düsseldorf (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 10/018,633

(22) PCT Filed: May 17, 2000

(86) PCT No.: PCT/EP00/04450

§ 371 (c)(1),
(2), (4) Date: Jan. 10, 2002

(87) PCT Pub. No.: WO00/78505

PCT Pub. Date: Dec. 28, 2000

(30) Foreign Application Priority Data

Jun. 18, 1999 (DE) ..... 199 28 022
Jan. 28, 2000 (DE) ..... 100 03 707

(51) Int. Cl.[7] ..... B24B 1/00
(52) U.S. Cl. ..... 451/45; 451/47
(58) Field of Search ..... 451/45, 224, 225, 451/229, 230, 234, 235, 293, 541, 548, 57, 58

(56) References Cited

U.S. PATENT DOCUMENTS 1,935,679 A * 11/1933 Vassiliev ..... 451/556
1,937,043 A * 11/1933 Martin ..... 51/298
1,966,408 A * 7/1934 Hauman ..... 501/119
2,138,829 A * 12/1938 Benner et al. ..... 51/309
2,138,882 A * 12/1938 Robie ..... 451/536
2,292,758 A * 8/1942 Hite ..... 51/307
2,408,946 A * 10/1946 Nelson ..... 51/308
3,332,173 A * 7/1967 McMaster ..... 451/282
3,900,636 A * 8/1975 Curry et al. ..... 427/526
3,988,955 A * 11/1976 Engel et al. ..... 83/661
5,032,243 A * 7/1991 Bache et al. ..... 204/192.34
5,347,887 A * 9/1994 Rosenthal et al. ..... 76/104.1
5,711,774 A 1/1998 Sheldon ..... 51/307
5,724,868 A * 3/1998 Knudsen et al. ..... 76/104.1
5,876,470 A 3/1999 Abrahamson ..... 51/309

FOREIGN PATENT DOCUMENTS

WO WO 98/15387 4/1998
WO WO 99/06500 2/1999

* cited by examiner

*Primary Examiner*—M. Rachuba
(74) *Attorney, Agent, or Firm*—Herbert Dubno; Andrew Wilford

(57) ABSTRACT

The invention relates to a grinding wheel for grinding a blade, on the surface of which ions are deposited by means of a plasma-supported method and containing silicon carbide as abrasive medium with a grain size ranging from 100 to 500 mesh, said material being deposited in a ceramic based binding agent with aluminum silicate. The abrasive medium grains are thermally hardened and bonded in the porous aluminum silicate bond. Abrasive medium concentration in the grinding wheel is higher than 1 volume %. Said grinding wheel is used in a grinding system for rough grinding the blade. Polishing is then cared out with a second grinding wheel containing pure corundum as abrasive medium with a grain size ranging from 400 to 800 mesh, which is deposited a in multicomponent synthetic resin, preferably a phenol resin based resin with a concentration of more than 1 volume %, preferably 30 to 50%. The abrasive medium contains polishing-active filling materials with a volume fraction ranging between 3% and 10%.

8 Claims, No Drawings

GRINDING WHEEL, GRINDING SYSTEM AND METHOD FOR GRINDING A BLADE

CROSS REFERENCE TO RELATED APPLICATIONS

This application is the US national phase of PCT application PCT/EP00/04450 filed May 17, 2000 with a claim to the Priority of German patent application 19928022.3 itself filed Jun. 18, 1999 and PCT Patent application PCT/EP00/04450 itself filed May 17, 2000.

FIELD OF THE INVENTION

The invention relates to a grinding wheel and grinding system for grinding a blade in whose surface foreign ions are imbedded by a plasma-supported method, as well as a method of grinding such a blade with a grinding wheel.

BACKGROUND OF THE INVENTION

In longitudinal- and cross-cutting machines for paper or cardboard webs or plastic or metal foils a steel blade is used whose surface has been treated to increase its wear resistance. Longitudinal web cutters have as is known pairs of rotating disk blades that cut longitudinally through the web. Transverse cutting machines for creating individual sheets from a material web have a transverse cutter with two blade drums each provided on its surface with one or move transverse blades extending the full length of the drum.

German patent application 198 40 950 describes a particularly advantageous blade for cutting moving material webs that has a blade with a steel cutting edge with at least the surface of the cutting edge coated by means of a plasma-supported method with foreign ions with a penetration depth between 50 $\mu$m and 500 $\mu$m, preferably 100 $\mu$m to 200 $\mu$m. Dosing the foreign ions in the metal lattice serves to improve the hardness of the cutter optimally without making the steel too brittle or influencing its ductility.

It has been shown in practice that the grinding of such a blade with the known grinding disks and grinding procedures is unsatisfactory, in particular the cutting edge fractures during grinding.

OBJECT OF THE INVENTION

It is therefore an object of the invention to provide a grinding wheel, a grinding system, and a grinding method by means of which the blade of German patent application 198 40,950 can be ground to a higher quality.

SUMMARY OF THE INVENTION

The object is achieved by a grinding wheel which has as grinding medium silicon carbide in a particle size between 100 mesh that is imbedded in a ceramic-base binder with aluminum silicate, the grinding particles being thermally bound and hardened in the porous aluminum-silicate binder and the concentration of the grinding medium in the grinding wheel being more than 1% by volume.

Preferably the concentration of the grinding medium in the grinding disk is between 30 and 55% by volume and the pore volume of the binder is between 45 and 70% by volume.

The grinding system for achieving the second object uses a first grinding disk for coarse grinding with the above-described characteristics and a second grinding disk for polishing the cutting edge of the blade that has as grinding medium pure corundum with a particle size between 400 mesh and 800 mesh, preferably with an average particle size between 500 mesh and 700 mesh, in particular about 600 mesh.

Preferably the second grinding disk for polishing has a grinding medium that has a binder of a multicomponent synthetic resin, preferably a phenol, with a concentration of more than 1% by volume, preferably 30 to 50% by volume, and a polishing filler with a percent by volume of between 3% and 10%.

The method of grinding a blade to achieve the third object is carried out such that the blade is ground with a grinding disk according to one of claims 1 or 2 with a grinding speed of 5 m/sec to 15 m/sec, preferably 10 m/sec.

Preferably the blade is first coarse ground with a grinding wheel according to one of claims 1 or 2 with a grinding speed of 5 m/sec to 15 m/sec, preferably 10 m/sec, and then is polished with the second grinding wheel according to one of claims 3 or 5 with a grinding speed of 20 m/sec to 30 m/sec, preferably about 25 m/sec.

SPECIFIC DESCRIPTION

The grinding system according to the invention uses two different grinding wheels of different compositions. The first grinding wheel serves for coarse grinding the blade, the second grinding wheel fro polishing the cutting edge.

Both grinding wheels have an outside diameter between 100 mm and 500 mm and a center hole with a diameter between 20 mm and 150 mm so that they can be used in a standard grinder. The thickness of the grinding wheels is between 8 mm and 40 mm.

The first grinding wheel for the coarse grinding has as grinding medium silicon carbide in a particle size between 100 mesh and 500 mesh, the average particle size preferably being about 220 mesh. The grinding medium is imbedded in an aluminum-silicate ceramic base. The grinding particles are thermally hardened and bound in this porous aluminum-silicate binder. The hardening temperature is 800° C.–1500° C. The pore volume is preferably 45–70%. The concentration of grinding medium in the grinding disk is more than 1% by volume, preferably 30–55% by volume.

The second grinding wheel for polishing the cutting edge has as grinding medium pure corundum in a particle size between 400 mesh and 800 mesh, the average particle size preferably being between 500 mesh and 700 mesh, in particular about 600 mesh. The grinding medium is imbedded in a binder of a multicomponent synthetic resin, preferably of a phenolic-resin base. The concentration of the grinding medium in the synthetic resin is more than 1% by volume, preferably 30–50%. The grinding medium contains polishing fillers at 3% to 10% by volume.

The grinding of the ion-implanted blade with the grinding wheels is done with below-average grinding speeds. To start with the first grinding wheel is used for coarse grinding at a grinding speed of 5 m/sec to 15 m/sec, preferably about 10 m/sec. Then the cutting edge is polished with the second grinding wheel, the grinding speed preferably being 20 m/sec to 30 m/sec, preferably about 25 m/sec. In this manner the ion-implanted blade is ground to a high quality.

What is claimed is:

1. A method of grinding a blade in whose surface foreign ions are imbedded by a plasma-supported method, the method comprising the steps of sequentially:

coarse grinding the blade with a coarse grinding wheel having a porous aluminum-silicate ceramic-base binder and grinding particles imbedded, thermally bound, and hardened in the binder, the grinding particles accounting for more than 1% by volume of the wheel; and polishing a cutting edge of the blade the blade with a fine grinding wheel in which are imbedded pure corundum particles of a size between 400 mesh and 800 mesh.

2. The method defined in claim 1 wherein the pure corundum particles have a size between 500 mesh and 700 mesh.

3. The method defined in claim 2 wherein the pure corundum particles have a size of about 600 mesh.

4. The method defined in claim 1 wherein the fine grinding wheel comprises:

a binder of a multicomponent synthetic resin, grinding particles imbedded in the synthetic-resin binder at a concentration of more than 1% by volume of the wheel, and a polishing filler at a concentration of between 3% and 10% by volume.

5. The method defined in claim 1 wherein the coarse grinding wheel is moved at a grinding speed of between 5 m/sec and 15 m/sec.

6. The method defined in claim 5 wherein the coarse grinding wheel is moved at a grinding speed of about 10 m/sec.

7. The method defined in claim 1 wherein the fine grinding wheel is moved at a grinding speed of between 20 m/sec and 30 m/sec.

8. The method defined in claim 5 wherein the fine grinding wheel is moved at a grinding speed of about 25 m/sec.

* * * * *